United States Patent [19]

Glickman et al.

[11] Patent Number: 4,657,150

[45] Date of Patent: Apr. 14, 1987

[54] OVERHEAD CRANE HAVING BRIDGE MOUNTED FOR DIFFERENTIAL MOVEMENT

[75] Inventors: Myron Glickman, Morton Grove; James A. Baumann, Orland Park, both of Ill.

[73] Assignee: Mi-Jack Products, Inc., Hazel Crest, Ill.

[21] Appl. No.: 853,911

[22] Filed: Apr. 21, 1986

[51] Int. Cl.[4] ..... B66C 19/00

[52] U.S. Cl. ..... 212/218; 212/220

[58] Field of Search ..... 212/205, 209, 211, 212, 212/218-220

[56] References Cited

U.S. PATENT DOCUMENTS 3,061,110 10/1962 Montgomery ..... 212/220
3,262,580 7/1966 Markowitz ..... 212/218
3,645,406 2/1972 Brazell ..... 212/220
3,945,504 3/1976 Wright ..... 212/220

FOREIGN PATENT DOCUMENTS 228242 6/1969 U.S.S.R. ..... 114/218

*Primary Examiner*—Joseph F. Peters, Jr.
*Assistant Examiner*—Stephen P. Avila
*Attorney, Agent, or Firm*—George H. Gerstman

[57] ABSTRACT

A trolley having an overhead movable bridge supporting a grappler device to lift and lower cargo containers. The bridge is movable along parallel tracks on a trolley. The bridge is capable of undergoing limited differential rotational motion with respect to the trolley and parallel tracks. The rotational mounting of the bridge permits the trolley wheels to maintain proper alignment with the beams while the grappler handles containers lying at an angle to the longitudinal axis of the crane.

9 Claims, 6 Drawing Figures

OVERHEAD CRANE HAVING BRIDGE MOUNTED FOR DIFFERENTIAL MOVEMENT

BACKGROUND OF THE INVENTION

1. Field of the Invention

This invention relates to overhead cranes for handling containers and particularly to an overhead crane having a bridge mounted for rotational movement on its trolley to handle containers which are not aligned with the axis of the crane.

2. Description of the Prior Art

Overhead cranes are commonly utilized to lift, lower and transport containers from various vehicles, from vehicles to storage areas, from ships to vehicles, and the like. An overhead crane generally employs a movable bridge under which a grappler device is suspended through a cable or rope system for attachment to containers of standard design. It is a common problem in the handling of cargo containers that the crane is moved into a position at which its longitudinal axis does not coincide with the alignment of the container beneath the bridge. Since the grappler is generally oriented symmetrically with the crane frame, misalignment between the load and grappler will then occur. To properly handle cargo containers in such a situation with known equipment, the crane must be moved and reoriented so that proper alignment of the cargo with the grappler is achieved. Although it is possible to a limited extent to handle containers which are misaligned with the crane by present designs, it is a common problem that the container begins swaying or other movement from forces induced from the hoist system or even the rope upon the pulleys of the hoist system may become disengaged and cause possible damage to the container due to impact. Accordingly there is a longfelt need to provide an overhead crane apparatus having the ability to safely handle misaligned cargo containers without the necessity of maneuvering the crane to an appropriate parallel alignment with the containers being handled.

SUMMARY OF THE INVENTION

It is the objective of the present invention to provide an overhead crane having a movable bridge, a hoist system and a grappler which is capable of safely and effectively handling misaligned containers. The apparatus of the invention provides an adjustable bridge capable of limited differential movement on the trolley to allow the grappler to rotate its position at an angle with respect to the center line of the top beam and properly engage misaligned containers for lifting and other manipulation. The grappler system is mounted for connective rotational movement in response to the differential rotational motion of the bridge on the trolley. Differential motion is effected by hydraulic means which cause the pivotally mounted bridge to rotate relative to the trolley frame in either direction and effect accompanying adjusting movement of the grappler and its supporting pulleys. This action insures that the pulley and cable remain properly engaged while handling a misaligned container. After being lifted, the load may then be properly aligned by returning the bridge to its normal position.

The invention of the application therefore eliminates time consuming manipulation and handles misaligned containers without having to move and otherwise reorient the position of the overhead crane with respect to the cargo being lifted, or subjecting the container to swaying. Such improved performance provides greatly enhanced efficiency and safety in the handling of containers from vehicles, in the yard, or whatever other use to which the crane apparatus is intended. The differential bridge motion is attained by an extremely effective technique which does not involve costly, elaborate mechanisms and which is capable of extended trouble-free service.

DESCRIPTION OF THE PREFERRED EMBODIMENT

Figure 1:
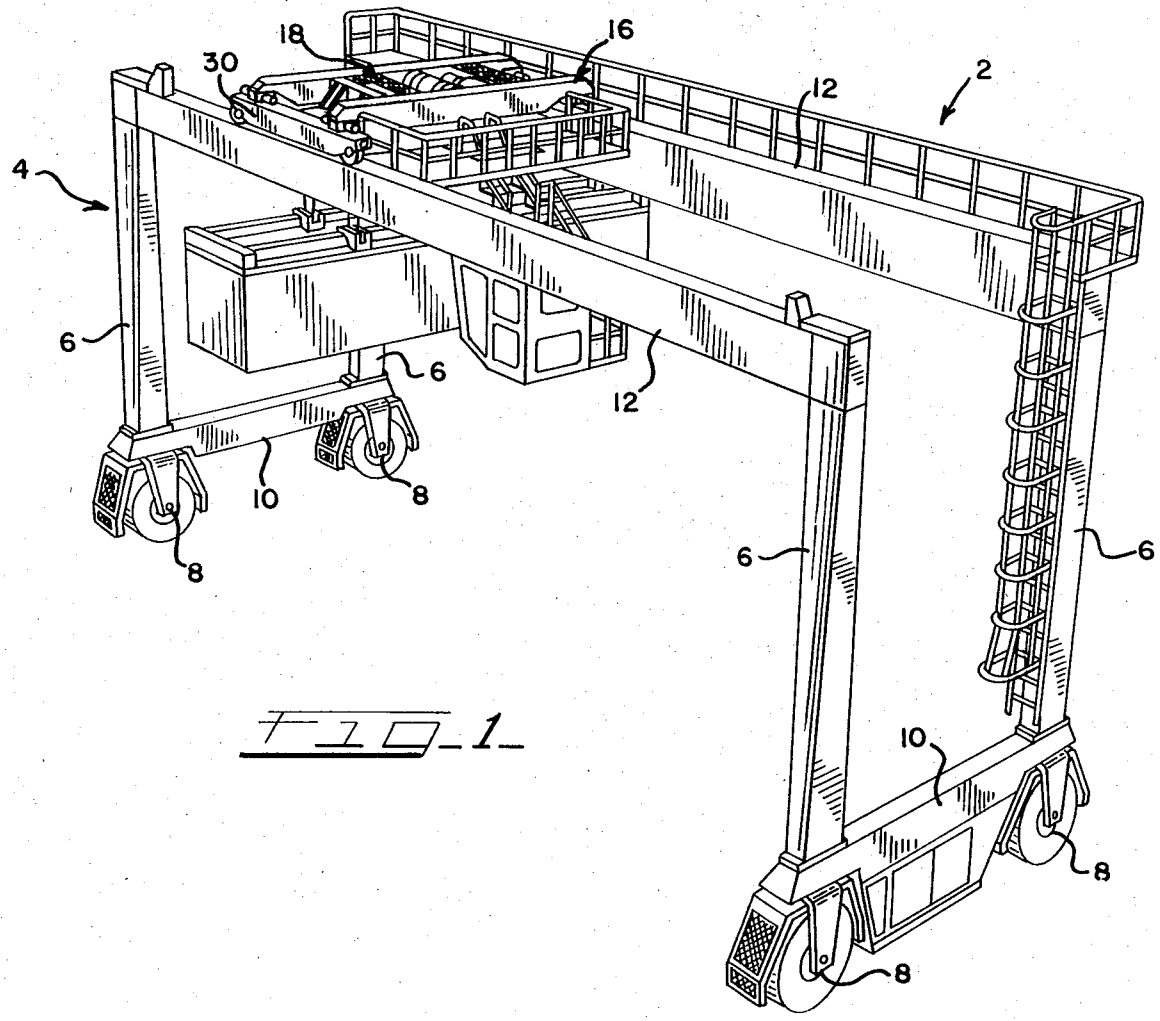
FIG. 1 is a perspective view of an overhead crane apparatus having the pivotal bridge of the invention.

Referring now to the drawings, and more particularly FIG. 1, there is shown the gantry crane apparatus, generally designated by reference numeral 2, which incorporates the preferred embodiment of the present invention. Although the crane apparatus 2 shown in FIG. 1 illustrates specific conventional features, it is within the scope of the invention to utilize the improved bridge mounted for differential movement herein disclosed with other crane equipment having an overhead hoist system.

A frame 4 of the crane 2 includes four upright legs 6 supported by respective wheel assemblies 8. Each of the wheel assemblies 8 are pivotally attached to the lower end of upright legs 6 for steering movement about a vertical axis. The frame 4 of crane 2 further includes a pair of lower longitudinal beams 10 and a pair of parallel upper beams 12 defining the width of the crane apparatus 2, which are attached to the top of the legs 6. The upper beams 12 support respective parallel tracks 14 on which the bridge assembly 16 is mounted for traverse movement along tracks 14. A hoist system 18 suspends a grappler assembly 20 having a number of attachment devices to grasp and retain one or more containers beneath the bridge 16.

Figure 5:
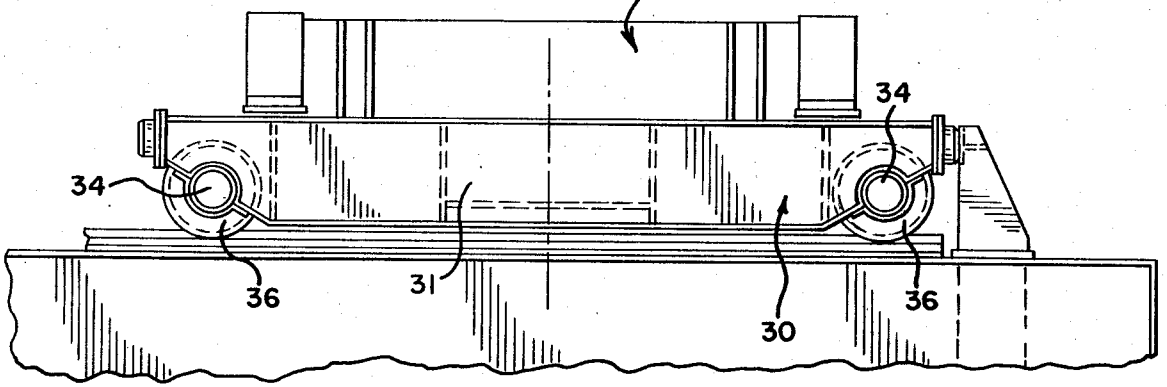
FIG. 5 is a side elevational view of the bridge taken along lines 5—5 of FIG. 4.

The bridge assembly 16 is supported on a trolley assembly 30 defined by a pair of side members 31 that are interconnected by cross-undercarriage 32. As seen in FIG. 5, the side members 31 support a pair of axles 34 having trolley wheels 36, generally constructed of a metal. The trolley wheels 36 are driven by hydraulic drive motors 38 through a hydraulic line 39 including a valve bank 40 and filters 42 as shown in FIG. 3.

The bridge assembly 16 rotatably carries a hoist drum 50 that is driven by hoist drum motor 52. The hoist drum 50 carries ropes or cables 53 (FIG. 4) which are disposed about the periphery of pulleys 54. The pulleys 54 are retained in a conventional manner to pulley brackets 56 rigidly depending downward from the bridge assembly 16 as seen in FIG. 4. The bridge assembly 16 is provided with parallel beams 58 spanning the distance between the tracks 14 and bearing against the top of trolley side members 37 at each end. A bridge box structure 59 is disposed between the bridge beams 58 to provide a service platform 59' and to mount the hoist drum motor 52, hoist drum 50 and other components on the bridge assembly 16 as shown in FIG. 3.

Figure 2:
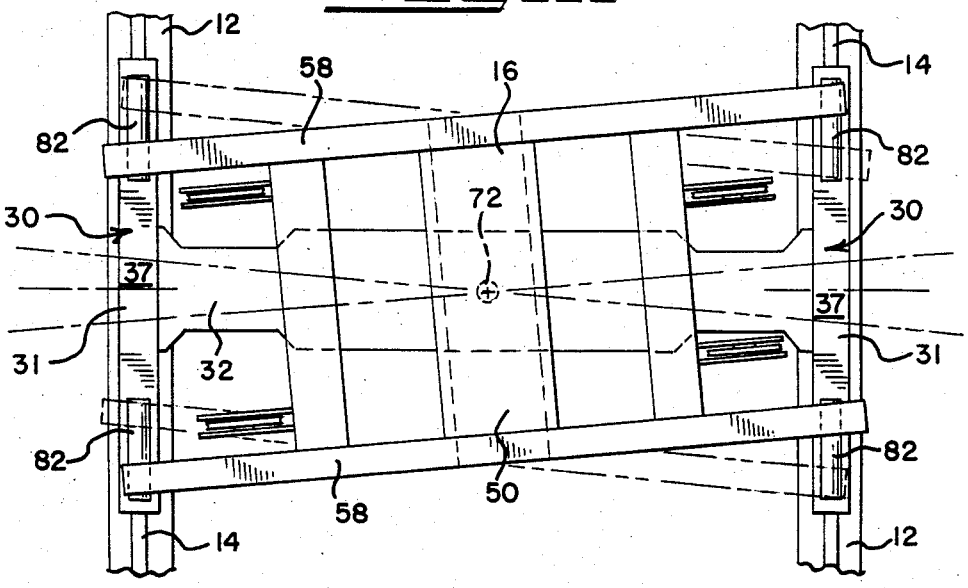
FIG. 2 is a top schematic view of the bridge of the crane apparatus of FIG. 1 undergoing differential motion.
Figure 3:
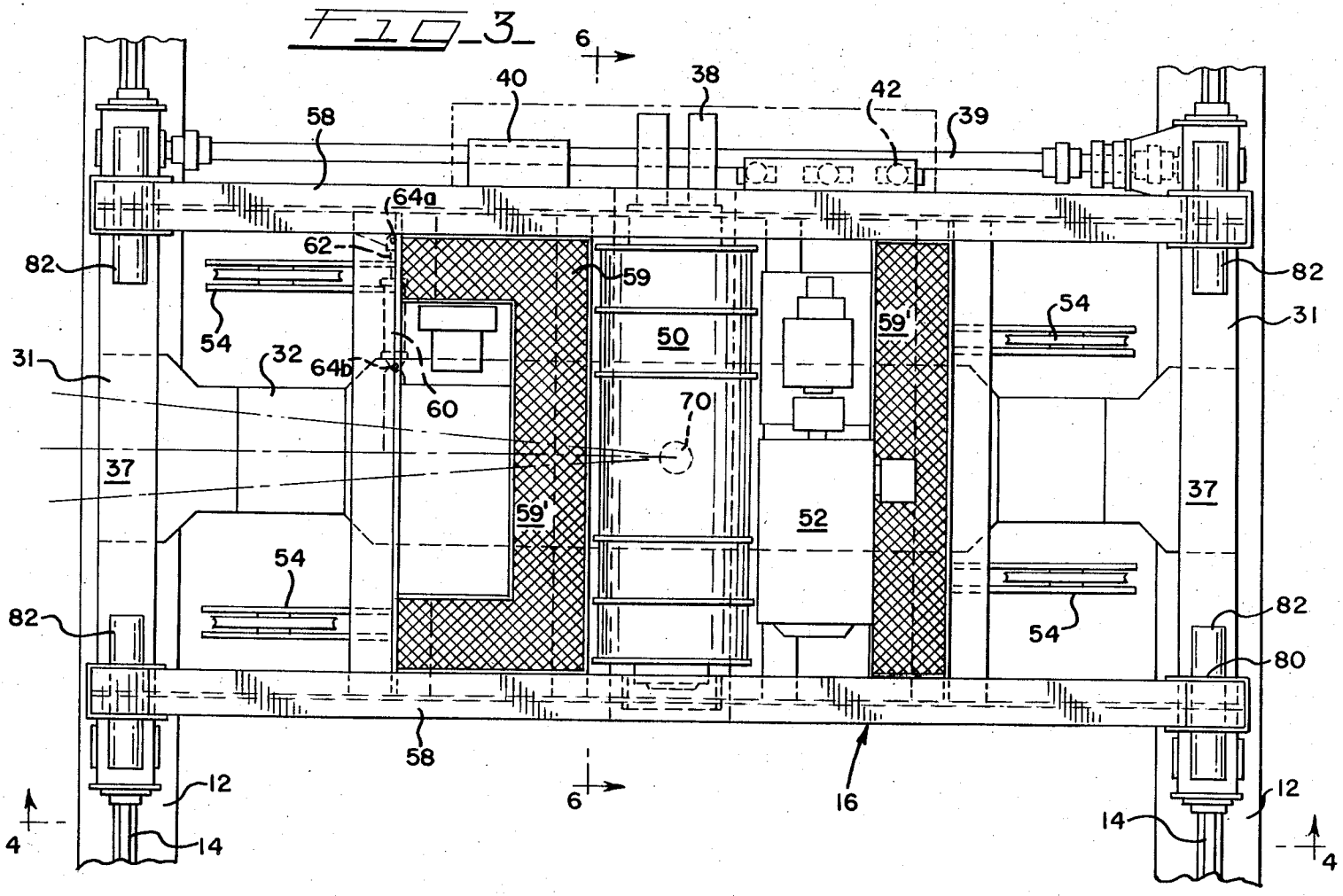
FIG. 3 is a top schematic view of the bridge of the overhead crane in FIG. 1.
Figure 4:
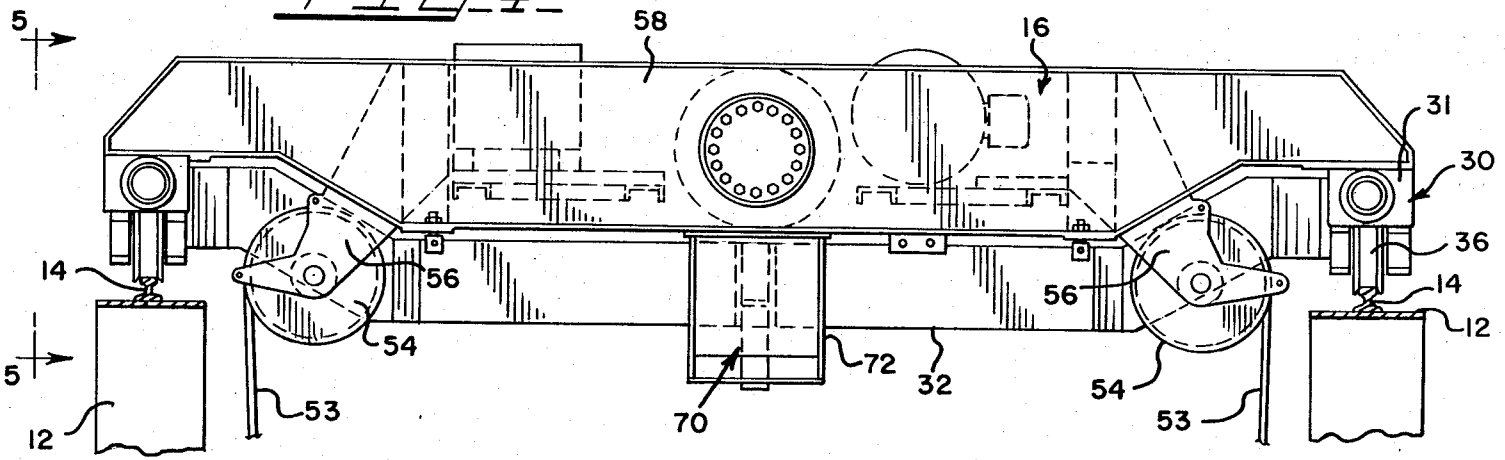
FIG. 4 is an end elevational view of the bridge of FIG. 3.

Referring now to FIGS. 2, 3 and 4, there is illustrated the rotational mounting of the bridge 16 for differential movement with respect to the trolley assembly 30. A hydraulic skew cylinder 60 having an extendible end 62 is mounted to an underside portion of the bridge 16 through the means of a spherical bearing mount **64*a* affixed to the beams 38 of the bridge frame. The mounting end of the skew cylinder 60 is secured by a spherical bearing mount 64*b* to the cross member or undercarriage 32. As best shown in FIG. 3, the skew cylinder 60 is mounted at an offset position from the vertical center line between the two tracks 14 so that the skew cylinder is capable of inducing a torque on the bridge assembly 16** in either direction about a vertical axis.

Figure 6:
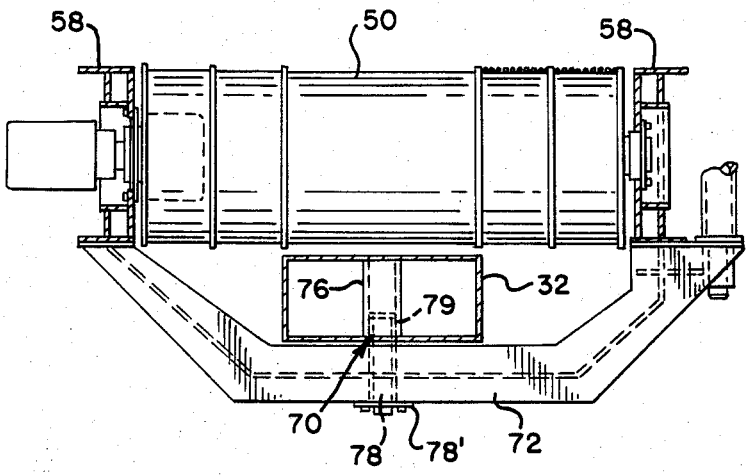
FIG. 6 is a partial sectional view taken along lines 6—6 of FIG. 3.

The bridge assembly 16 is pivotally mounted on the undercarriage by a pivotal mount 70 affixed to the bottom frame 72 of the bridge as best shown in FIG. 6. The base member 72 is affixed at each end to the underside of bridge beams 58. The undercarriage 32 further includes a sleeve 76 aligned vertically with an inner hollow shaft 78 affixed to frame 72 by bracket 78'. The shaft 78 projects upward into sleeve 76 and is mounted for rotation therein by means of a self-aligning radial bushing 80 positioned within the sleeve 76. Accordingly, the pivotal mounting 70 permits the base member 72, when viewing FIG. 2, to rotate relative to the undercarriage 32 of the trolley in either direction. As best shown in FIGS. 2 and 3, the amount of angular movement generally is limited to any suitable range, such as, for example, approximately 5° in either direction. To accomplish such motion of the bridge relative to the undercarriage, the extendible end 62 of the hydraulic skew cylinder 60 is positioned at a neutral position. Extension of the end 62 moves the bridge assembly 16 in one direction, while withdrawal of the extendible end 62 from the neutral position moves the bridge assembly 16 in the other direction. Accordingly, pivotal movement of the bridge may be accomplished by use of one skew cylinder, although other means for causing rotation, such as motors, a pair of oppositely disposed cylinders, or other motion-inducing means may be employed in the invention.

The lower surface 80 of the bridge assembly 16 is arranged to rest on slide bearings 82 positioned on the upper surface of the trolley frame 31 as best shown in FIG. 3. The slide bearings 82 comprise a pad of low-friction material, such as any Teflon substance and the like, that permits the lower surface of the bridge frame to move on the trolley without undue friction during differential movement. The lower surface of the bridge assembly 16 in contact with the bridge frame, likewise, may include a low-friction material.

In operation of the bridge of the invention, it is only necessary to activate the skew cylinder 60 by withdrawing or extending the extendible end 62 for the desired amount to cause the bridge assembly 16 to rotate relative to the trolley assembly 30 while the wheels 36 maintain proper alignment on the track 14. Movement of the bridge causes a pivotal motion of the pulleys 54 and rope 53, as well as the grappler suspended thereunder. By controlling the amount of the rotation of the bridge in differential movement to the trolley, the grappler can be aligned in a skewed manner to the axis of the crane and grip any misaligned containers and the like below. After the container or containers are lifted, the bridge assembly 16 may then be rotated to its neutral position.

What is claimed is:

1. An overhead crane apparatus comprising frame means forming a pair of parallel tracks;

hoist means;

bridge means spanning said parallel tracks and being operatively connected to said hoist means, said hoist means suspending a grappler device beneath said bridge means;

trolley means carrying said bridge means for movement along said parallel tracks;

pivot means centrally located between said parallel tracks and mounting said bridge means for central pivotal movement of said bridge means about a generally vertical axis about a generally vertical axis, with the amount of movement of the bridge means relative to each of said pair of parallel tracks being equal; and means for causing said central pivotal movement of said bridge means for corrective movement of said grappler device.

2. The apparatus according to claim 1 wherein said means for causing said pivotal movement is a hydraulic cylinder means arranged between said between trolley means and said bridge means.

3. The apparatus according to claim 2 wherein said bridge means includes a frame, a portion of said frame carried on said trolley means.

4. The apparatus according to claim 3 further comprising bearing means being imposed between said portion of said frame and said trolley means.

5. The apparatus according to claim 4 wherein said bearing means includes a pad of low friction material.

6. The apparatus according to claim 4 wherein said trolley means includes an undercarriage, said bridge means being rotatably mounted to said undercarriage.

7. The apparatus according to claim 1 wherein said bridge means is mounted for limited pivotal movement in two directions.

8. The apparatus according to claim 7 wherein said bridge means is limited to pivotal movement of approximately 5° in either direction.

9. The apparatus according to claim 1 wherein said bridge means comprises a pair of parallel beams and said pivot means is centrally located between said parallel beams.

* * * * *